US007398897B1

(12) United States Patent
Walker

(10) Patent No.: US 7,398,897 B1
(45) Date of Patent: Jul. 15, 2008

(54) TOOTHPASTE HOLDER

(76) Inventor: Tony Walker, 2144 Crotona Pkwy., #5A, Bronz, NY (US) 10460

( * ) Notice: Subject to any disclaimer, the term of this patent is extended or adjusted under 35 U.S.C. 154(b) by 0 days.

(21) Appl. No.: 10/447,535

(22) Filed: May 28, 2003

Related U.S. Application Data

(60) Provisional application No. 60/383,647, filed on May 29, 2002.

(51) Int. Cl.
*B65D 35/28* (2006.01)

(52) U.S. Cl. ..... 222/98; 222/93

(58) Field of Classification Search ..... 222/98, 222/99, 93, 95
See application file for complete search history.

(56) References Cited

U.S. PATENT DOCUMENTS 2,760,681 A 8/1956 Arquelles
3,204,824 A 9/1965 McGraw
4,220,260 A * 9/1980 Webster ..... 222/100
5,277,332 A 1/1994 Rogers
5,676,279 A * 10/1997 Bastion ..... 222/93
5,957,334 A * 9/1999 Rosario ..... 222/102
6,318,596 B1 * 11/2001 Wiesner ..... 222/1
6,454,133 B1 * 9/2002 Lopez et al. ..... 222/102

* cited by examiner

*Primary Examiner*—Michael Mar
*Assistant Examiner*—Melvin A. Cartagena
(74) *Attorney, Agent, or Firm*—Matthew J. Pierce, Esq.

(57) ABSTRACT

An apparatus for both holding a tube of toothpaste and squeezing out a volume of toothpaste onto a toothbrush is disclosed. The apparatus would have an associated roller which would allow a user to squeeze out a small volume of toothpaste each time that it would be needed for brushing their teeth.

2 Claims, 2 Drawing Sheets

FIG 1
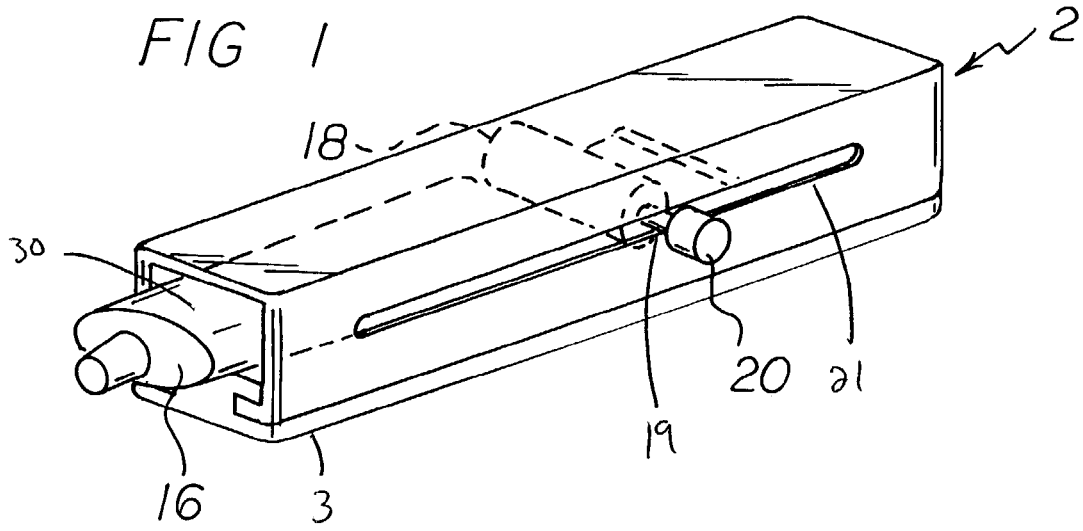
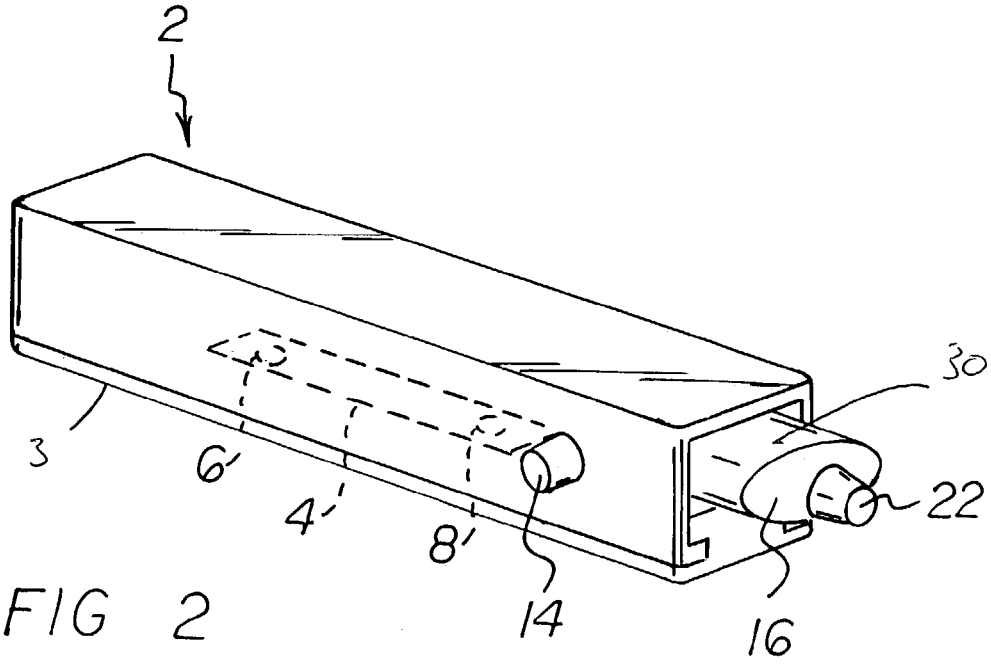
FIG 2

TOOTHPASTE HOLDER

This application claims the benefit of Provisional application Ser. No. 60/383,647, filed May 29, 2002.

I. BACKGROUND OF THE INVENTION

The present invention concerns that of a new and improved apparatus for both holding a tube of toothpaste and squeezing out a volume of toothpaste onto a toothbrush.

II. DESCRIPTION OF THE PRIOR ART

U.S. Pat. No. 5,277,332, issued to Rogers, discloses a multiple dispenser for various household health related products including toothpaste.

U.S. Pat. No. 3,204,824, issued to McGraw Jr., discloses a dispenser device comprised of a wall engaged housing for a collapsible tube with a circular knob and clip assembly for dispensing such items as toothpaste.

U.S. Pat. No. 2,760,681, issued to Arquelles, discloses a toothpaste dispenser comprised of a housing with a guide track and shaft assembly.

III. SUMMARY OF THE INVENTION

The present invention concerns that of a new and improved apparatus for both holding a tube of toothpaste and squeezing out a volume of toothpaste onto a toothbrush. The apparatus would have an associated roller which would allow a user to squeeze out a small volume of toothpaste each time that it would be needed for brushing their teeth.

There has thus been outlined, rather broadly, the more important features of a toothpaste tube holder and squeezer that the detailed description thereof that follows may be better understood and in order that the present contribution to the art may be better appreciated. There are, of course, additional features of the toothpaste tube holder and squeezer that will be described hereinafter and which will form the subject matter of the claims appended hereto.

In this respect, before explaining at least one embodiment of the toothpaste tube holder and squeezer in detail, it is to be understood that the toothpaste tube holder and squeezer is not limited in its application to the details of construction and to the arrangements of the components set forth in the following description or illustrated in the drawings. The toothpaste tube holder and squeezer is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present toothpaste tube holder and squeezer. It is important, therefore, that the claims be regarded as including such equivalent constructions insofar as they do not depart from the spirit and scope of the present invention.

It is therefore an object of the present invention to provide a toothpaste tube holder and squeezer which has all of the advantages of the prior art and none of the disadvantages.

It is another object of the present invention to provide a toothpaste tube holder and squeezer which may be easily and efficiently manufactured and marketed.

It is another object of the present invention to provide a toothpaste tube holder and squeezer which is of durable and reliable construction.

It is yet another object of the present invention to provide a toothpaste tube holder and squeezer which is economically affordable and available for relevant market segment of the purchasing public.

Other objects, features and advantages of the present invention will become more readily apparent from the following detailed description of the preferred embodiment when considered with the attached drawings and appended claims.

IV. BRIEF DESCRIPTION OF THE DRAWINGS

FIG. 1 shows a perspective view of the apparatus.

FIG. 2 shows an alternative perspective view of the apparatus.

V. DESCRIPTION OF THE PREFERRED EMBODIMENT

Figure 3:
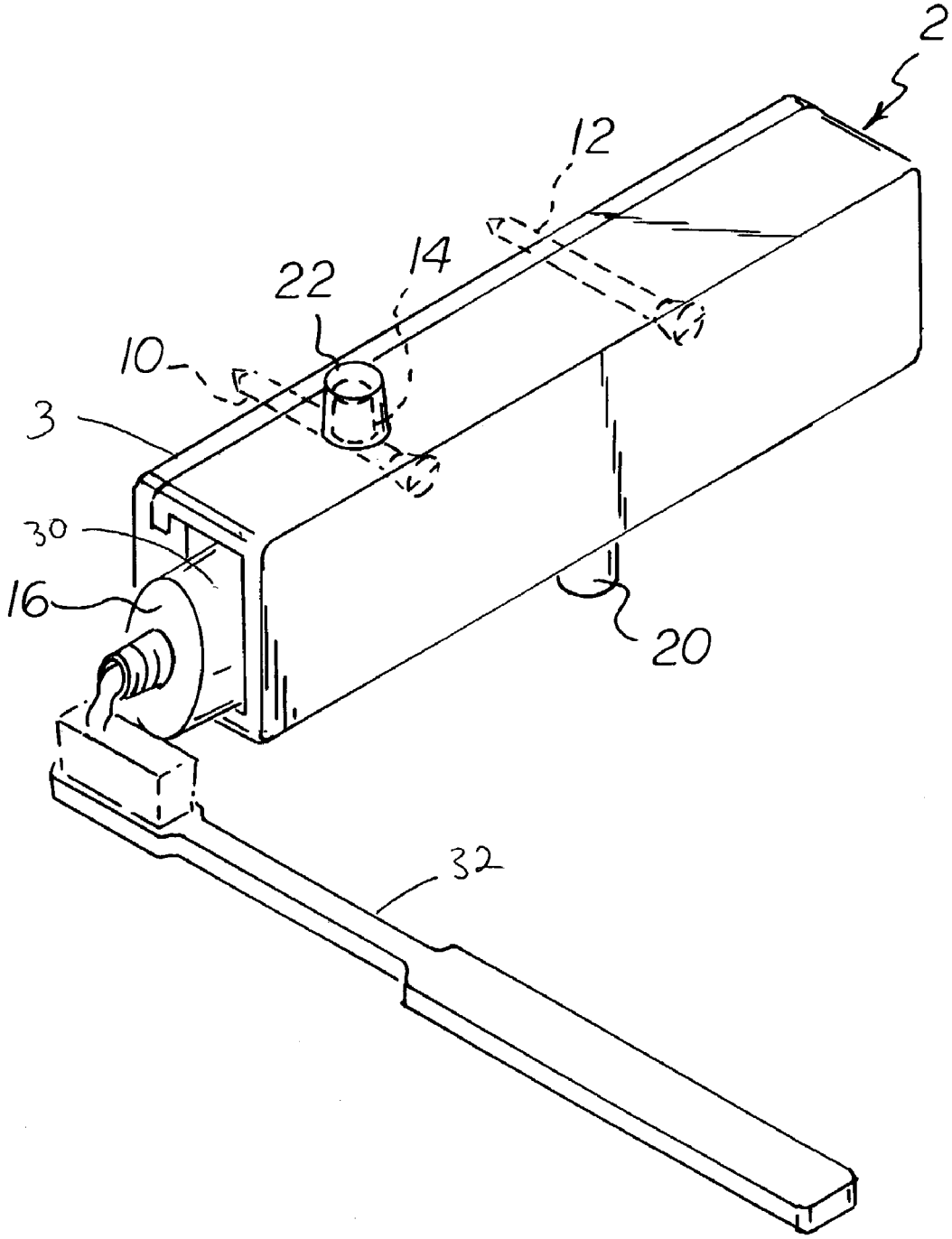
FIG. 3 shows the apparatus as it would appear in use.

Priority is hereby claimed to application 60/383,647, filed on May 29, 2002.

FIG. 1 shows a perspective view of the apparatus 2, while FIG. 2 shows an alternative perspective view of the apparatus 2. Apparatus 2 would be a toothpaste holder and would have two ends, a first end and a second end, two sides, a first side and a second side, and two main surfaces, a front surface and a rear surface. Apparatus 2 would be rectangular in shape and the first end of the apparatus 2 would be open.

Backing 3 of apparatus 2 would be a separate piece and would have two faces, an outer face and an inner face. The first side and the second side of the apparatus 2 would be track-mounted onto the inner face of backing 3 of apparatus 2 once the outer face of the backing 3 of the apparatus 2 has been fixedly mounted to a wall surface.

The outer face of the backing 3 has attached tape 4, along with a pair of screw holes 6 and 8. When in use, as seen in FIG. 3, the tape 4 would be pressed against a wall surface and then screws 10 and 12 would be drilled through holes 6 and 8, respectively. After backing 3 of apparatus 2 has been attached to a wall surface, then the first side and the second side of apparatus 2 would be slid onto backing 3.

The second side of apparatus 2 has a top holder 14, which would be used to place a toothpaste cap from a toothpaste tube 16 when the tube 16 would be open. Top holder 14 is shown in FIGS. 2 and 3.

In FIG. 1, a roller 18 and a knob 20 can be seen, with a toothpaste tube 16 inserted through the first end of the holder 2. A continuous slot 21 is located on the most of the length of the first side of the holder 2. Toothpaste tube 16 has an incorporated volume of toothpaste 30 within it and has two ends, a cap end and a bottom end. Toothpaste cap 22 is attached to the cap end of the toothpaste tube 16.

Roller 18 itself has two ends, a first end and a second end. Connector 19 has two ends, a first end and a second end, with the first end of the connector 19 attached to the second end of the roller 18 and the second end of the connector 19 extending outward out of the continuous slot 21. Knob 20 has two ends, a first end and a second end, the first end of the knob 20 attached to the second end of the connector 19.

Once a toothpaste tube 16 has been inserted through the open first end of the apparatus 2, the roller 18 and knob 20 would be positioned over the closed end of the toothpaste tube 16. The diameter of roller 18 is slightly smaller than the distance inside the holder 2 between the front surface to the outer face of the backing. When a user would want to expel a small volume of toothpaste from the tube 16, the user first take off the toothpaste cap 22 and place it on the top holder 14. Then, the user would turn the knob 20 a small amount, causing a small amount of toothpaste to be squeezed out of the open end of the tube 16 onto a waiting toothbrush 32. When the user had expelled the desired volume of toothpaste from the tube, they would proceed to brush their teeth. After finished, the individual would proceed to place the toothpaste cap 22 back onto the open end of the toothpaste tube 16.

FIG. 3 shows the apparatus as it would appear in use. The top holder 14 on the second side of the apparatus 2 would be facing up, while the knob 20 would be facing downward. Cap 22 can be seen located on top holder 14.

What I claim as my invention is:

1. An apparatus for holding and squeezing a tube of toothpaste comprising:

(a) a backing fixedly attached to a wall surface, the backing having two surfaces, an outer surface and an inner surface, (b) a holder removably attached to the backing, the holder having two ends, a first end and a second end, two sides, a first side and a second side, and two main surfaces, a front surface and a rear surface, the first end of the holder being open, (c) a roller located within the holder, the roller having two ends, a first end and a second end, the diameter of the roller being slightly smaller than the distance within the holder from the front surface to the rear surface, (d) a continuous slot located on the first side of the holder, (e) a connector having two ends, a first end and a second end, the first end of the connector attached to the second end of the roller, the second end of the connector extending outward out of the continuous slot, (f) a knob having two ends, a first end and a second end, the first end of the knob attached to the second end of the connector, (g) a tube of toothpaste having two ends, a cap end and a bottom end, the tube of toothpaste inserted into the holder such that the cap end is visible through the first end of the holder, the tube of toothpaste having a cap attached to the cap end, (h) a volume of toothpaste within the tube of toothpaste, (i) a cap holder attached to the second end of the holder, (j) wherein an individual would remove the cap from the tube of toothpaste and place it on the cap end, further wherein the individual would grab the first end of the knob and turn the knob in a cylindrical fashion toward the first end of the holder, further wherein the roller would push against the toothpaste tube and squeeze the volume of toothpaste within the tube of toothpaste toward the cap end, causing a small amount of the volume of toothpaste to be expelled out of the cap end onto a waiting toothbrush, and further wherein the individual would removably attach the cap on the cap end of the tube of toothpaste.

2. An apparatus for holding and squeezing a tube of toothpaste according to claim 1 wherein the backing is fixedly attached to a wall surface by a pair of screws and a length of tape that attaches to both the outer surface of the backing and the wall surface.

* * * * *